US010373816B2

(12) United States Patent
Fischer et al.

(10) Patent No.: US 10,373,816 B2
(45) Date of Patent: Aug. 6, 2019

(54) METHOD FOR ENHANCING ELECTROSPRAY

(71) Applicants: Agilent Technologies, Inc., Santa Clara, CA (US); Memorial Sloan Kettering Cancer Center, New York, NY (US)

(72) Inventors: Steven M. Fischer, Santa Clara, CA (US); Justin R. Cross, New York, NY (US)

(73) Assignee: Agilent Technologies, Inc., Santa Clara, CA (US)

( * ) Notice: Subject to any disclaimer, the term of this patent is extended or adjusted under 35 U.S.C. 154(b) by 26 days.

(21) Appl. No.: 15/461,337

(22) Filed: Mar. 16, 2017

(65) Prior Publication Data

US 2017/0330740 A1 Nov. 16, 2017

Related U.S. Application Data

(60) Provisional application No. 62/352,831, filed on Jun. 21, 2016, provisional application No. 62/336,524, filed on May 13, 2016.

(51) Int. Cl.

*H01J 49/00* (2006.01)
*H01J 49/04* (2006.01)
*H01J 49/16* (2006.01)

(52) U.S. Cl.

CPC ..... *H01J 49/165* (2013.01); *H01J 49/0027* (2013.01); *H01J 49/0431* (2013.01)

(58) Field of Classification Search

None

See application file for complete search history.

(56) References Cited

U.S. PATENT DOCUMENTS 5,523,566 A * 6/1996 Fuerstenau ..... H01J 49/165 250/282
2007/0023677 A1* 2/2007 Perkins ..... H01J 49/107 250/425
2012/0181421 A1* 7/2012 Satoh ..... H01J 49/142 250/282

(Continued)

FOREIGN PATENT DOCUMENTS

EP 1564780 A2 * 8/2005 ..... H01J 49/04
EP 1564780 A2 * 8/2005 ..... H01J 49/04

(Continued)

OTHER PUBLICATIONS

Sabari, et al., "Intracellular Crotonyl-CoA Stimulates Transcription through p300-Catalyzed Histone Crotonylation", Molecular Cell, 2015, 58, 203-215.

(Continued)

*Primary Examiner* — Andrew Smyth

(57) ABSTRACT

Provided herein, among other things, is a method of ionizing a first stream of liquid by an electrospray ion source having a nebulizer, wherein the first stream of liquid may comprise an analyte. In some embodiments, the method may comprise: a) providing the first stream of liquid to the nebulizer; b) adding a second stream of liquid to the first stream of liquid, wherein the second stream of liquid comprises a co-solvent that has a relatively high boiling point and an enhancement solvent that a relatively high boiling; and c) nebulizing and ionizing the resulting liquid.

20 Claims, 8 Drawing Sheets

(56) References Cited

U.S. PATENT DOCUMENTS

2013/0140449 A1* 6/2013 Banks ..... G01N 33/78
250/282
2013/0306856 A1* 11/2013 Trimpin ..... H01J 49/16
250/282

FOREIGN PATENT DOCUMENTS

EP 1564780 A3 * 5/2006 ..... H01J 49/04
EP 1564780 A3 * 5/2006 ..... H01J 49/04
EP 1739720 A2 * 1/2007 ..... H01J 49/107
EP 1739720 A2 * 1/2007 ..... H01J 49/107
EP 2538208 A1 * 12/2012 ..... G01N 27/622
EP 2538208 A1 * 12/2012 ..... G01N 27/622

OTHER PUBLICATIONS

European Communication and Search Report dated Oct. 19, 2017 for European Application No. 17170012.3-1803, pp. 1-10.

Yamaguchi et al., "Utility of Postcolumn Addition of 2-(2-Methoxyethoxy)ethanol, a Signal-Enhancing Modifier, for Metabolite Screening with Liquid Chromatography and Negative Ion Electrospray Ionization Mass Spectrometry", Anal, Chem., Dec. 1, 1999, pp. 5386-5390, vol. 71, No. 23.

Koch et al., "Sensitivity improvement in hydrophilic interaction chromatography negative mode electrospray ionization mass spectrometry using 2-(2-methoxyethoxy)ethanol as a post-column modifier for non-targeted metabolomics", Journal of Chromatography a, 2014, pp. 209-216, vol. 1361.

* cited by examiner

METHOD FOR ENHANCING ELECTROSPRAY

CROSS-REFERENCING

This application claims the benefit of U.S. provisional application Ser. No. 62/352,831, filed on Jun. 21, 2016, and 62/336,524, filed on May 13, 2016, which applications are incorporated by reference herein.

BACKGROUND

ESI is a widely used field desorption ionization method that generally provides a means of generating gas phase ions with little analyte fragmentation (see, e.g., Fenn et al., Science 1989 246: 64-70). Furthermore, ESI is directly compatible with on-line liquid phase separation techniques, such as high performance liquid chromatography (HPLC) and capillary electrophoresis systems.

Increasing the sensitivity of electrospray ionization is desirable. Most developments in this area have focused on solvent and electrolyte composition, better drying, better nebulization or better ionization efficiency by miniaturization (e.g., by nanospray). This disclosure provides an alternative way to increase the sensitivity of electrospray ionization that uses a mixture of solvents.

SUMMARY

Provided herein, among other things, is a method for ionizing a first stream of liquid by an electrospray ion source. In some embodiments, the method may comprise: providing the first stream of liquid to the nebulizer of the ion source; adding a second stream of liquid to the first stream of liquid, where the second stream of liquid comprises a co-solvent that has a relatively low boiling point and an enhancement solvent that a relatively high boiling; and nebulizing and ionizing the resulting liquid.

Depending on how the method is implemented, the method can result in an increase in the sensitivity of detection of ions of an analyte in the first stream of liquid. The enhancement can be observed in positive ion mode and negative ion mode. If the electrospray ion source is operated positive ion mode, then the enhancement solvent should not be DMSO because this solvent is believed to cause ion suppression in positive ion mode.

BRIEF DESCRIPTION OF THE FIGURES

The skilled artisan will understand that the drawings, described below, are for illustration purposes only. The drawings are not intended to limit the scope of the present teachings in any way.

DEFINITIONS

Figure 1:
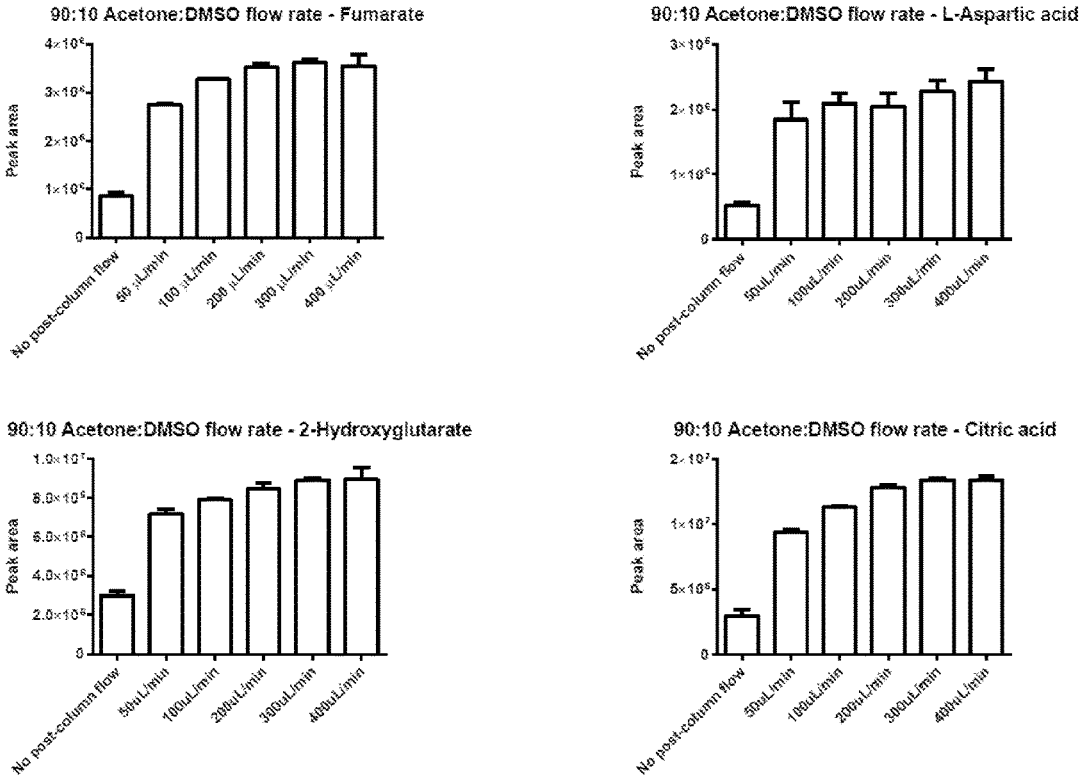
FIG. 1 is a series of graphs showing increased response (detection sensitivity) in the mass spectrometer for a variety biologically relevant molecules of varying masses and elemental compositions. In this example the primary liquid stream is a mixture of water and methanol with a flow rate of 400 μL/min. A secondary liquid stream is then added to the primary liquid stream containing the analytes, prior to nebulization, at flow rates from 12.5% to 100% of the primary stream. In this example acetone is the co-solvent and the enhancement solvent is DMSO, present at a 9:1 ratio. The compounds of interest are detected in negative ionization mode, and the response of all compounds in the mass spectrometer is increased by the addition of the enhancement and co-solvent blend to the primary liquid stream. Some compounds (e.g. ADP, GDP) are observed to require higher flow rates of the secondary liquid stream in order to achieve the maximum increase in response than others.
Figure 1:
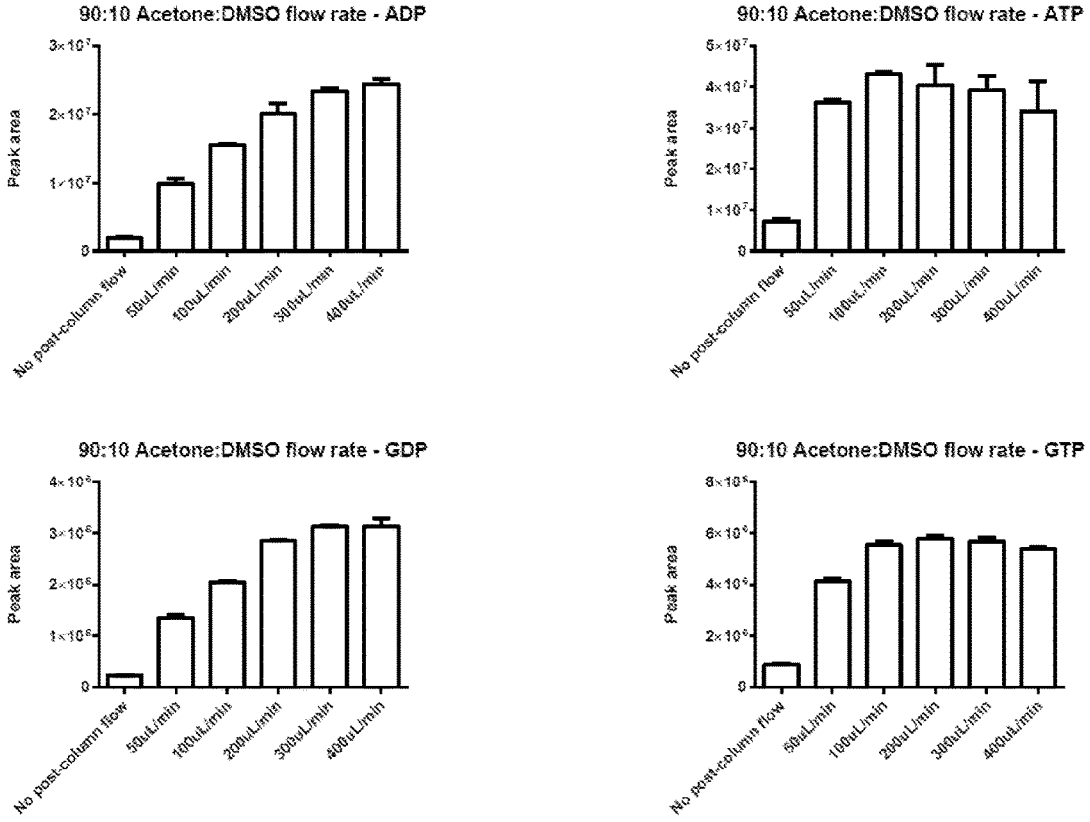
Figure 2:
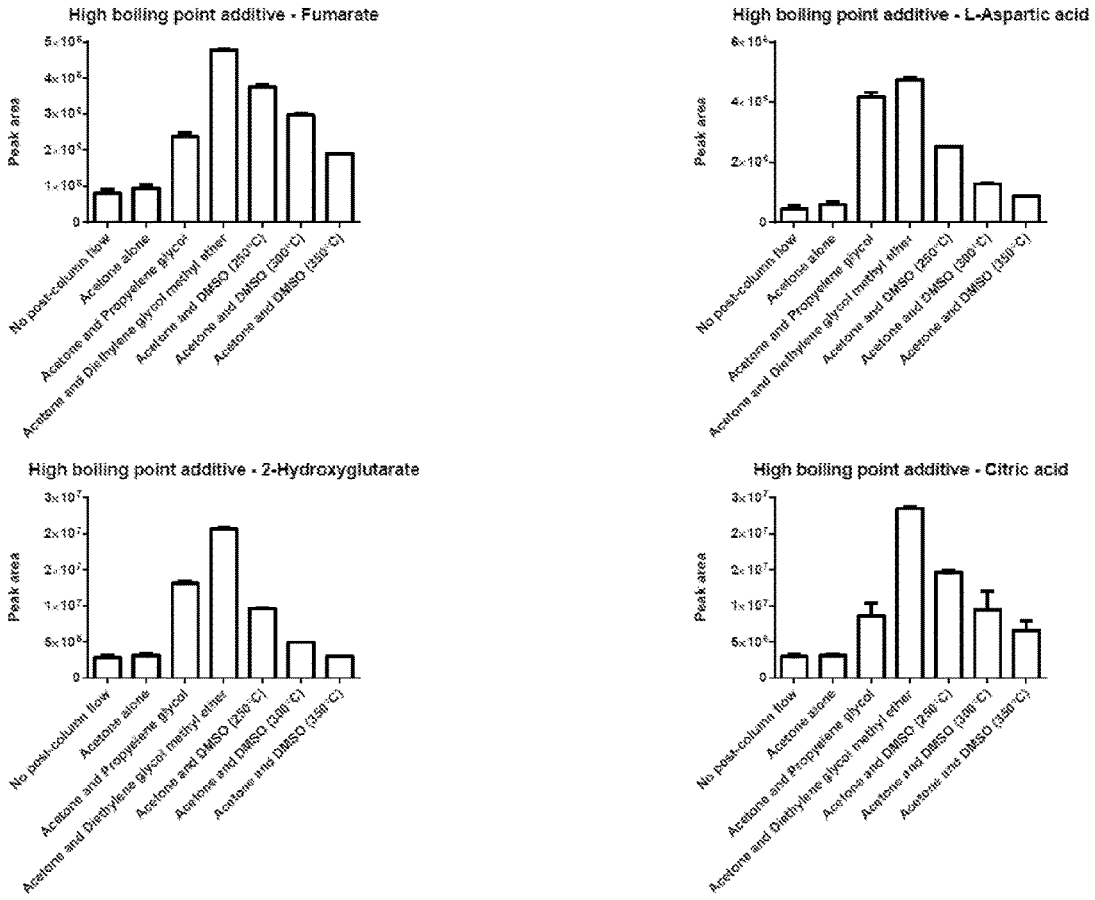
FIG. 2 is a series of graphs showing the enhancement solvent is required, in the presence of a co-solvent, to increase the response of a variety of biologically relevant molecules in the mass spectrometer. In this example the introduction of acetone alone into the primary liquid stream (the co-solvent) does not change the response of compounds when an enhancement solvent is not present (i.e., neither enhancement or dilution of the detected signal is observed). A variety of higher boiling point enhancement solvents are then shown that, when added to the acetone co-solvent, improve the response of analytes in the mass spectrometer. Here propylene glycol, diethylene glycol methyl ether and DMSO are shown as the enhancement solvent, the ratio of acetone co-solvent to enhancement solvent is 9:1 and the secondary liquid stream is added at 400 μL/min, equal to the primary liquid stream. For DMSO a temperature dependence is observed for some analytes, such that the sensitivity enhancement is more significant when the mass spectrometer is operated with lower source temperatures.
Figure 2:
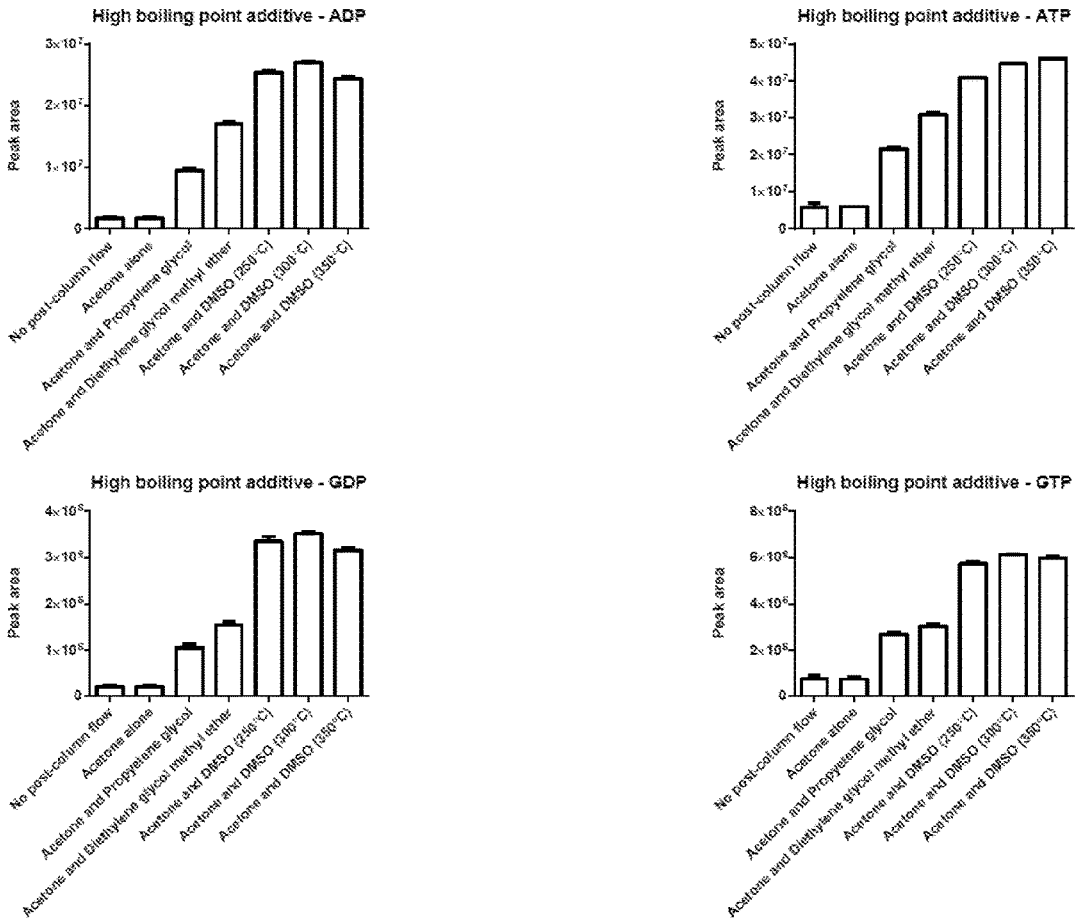
Figure 3:
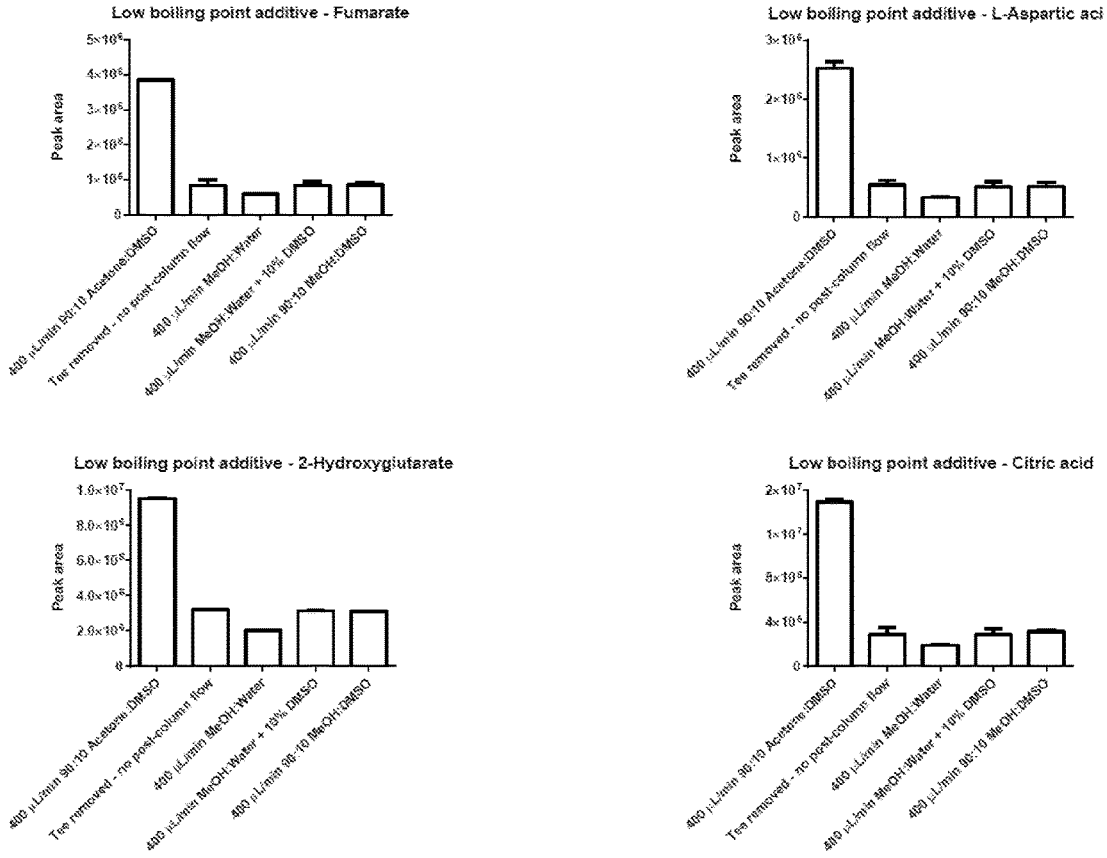
FIG. 3 is a series of graphs showing the co-solvent is required, in the presence of the enhancement solvent, to increase the response of a variety of biologically relevant molecules in the mass spectrometer. In this example the primary liquid stream is 400 μL/min and the secondary liquid stream is varied as indicated. No enhancement is seen when the secondary liquid stream is methanol and water, equivalent to the primary liquid stream (labeled: 400 μL/min MeOH:Water), or methanol and water supplemented with DMSO as an enhancement solvent (labeled: 400 μL/min MeOH:Water+10% DMSO). DMSO also fails to enhance analyte response when the secondary liquid stream is composed of 9:1 combination methanol and DMSO (labeled: 400 μL/min 90:10 MeOH:DMSO). However, when the enhancement solvent, in this case DMSO, is present with the appropriate low-boiling point co-solvent, in this case acetone, (labeled: 400 μL/min 90:10 Acetone:DMSO) increased response of all compounds of interest is observed.
Figure 3:
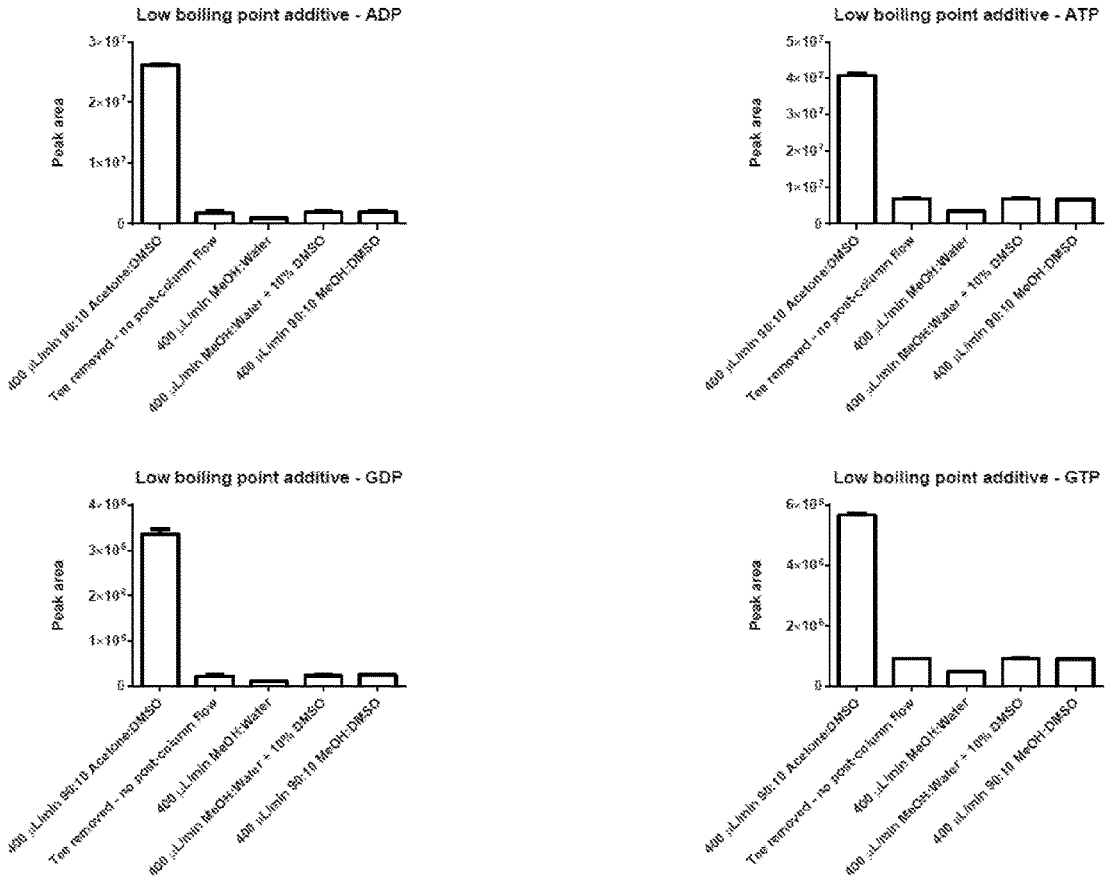
Figure 4:
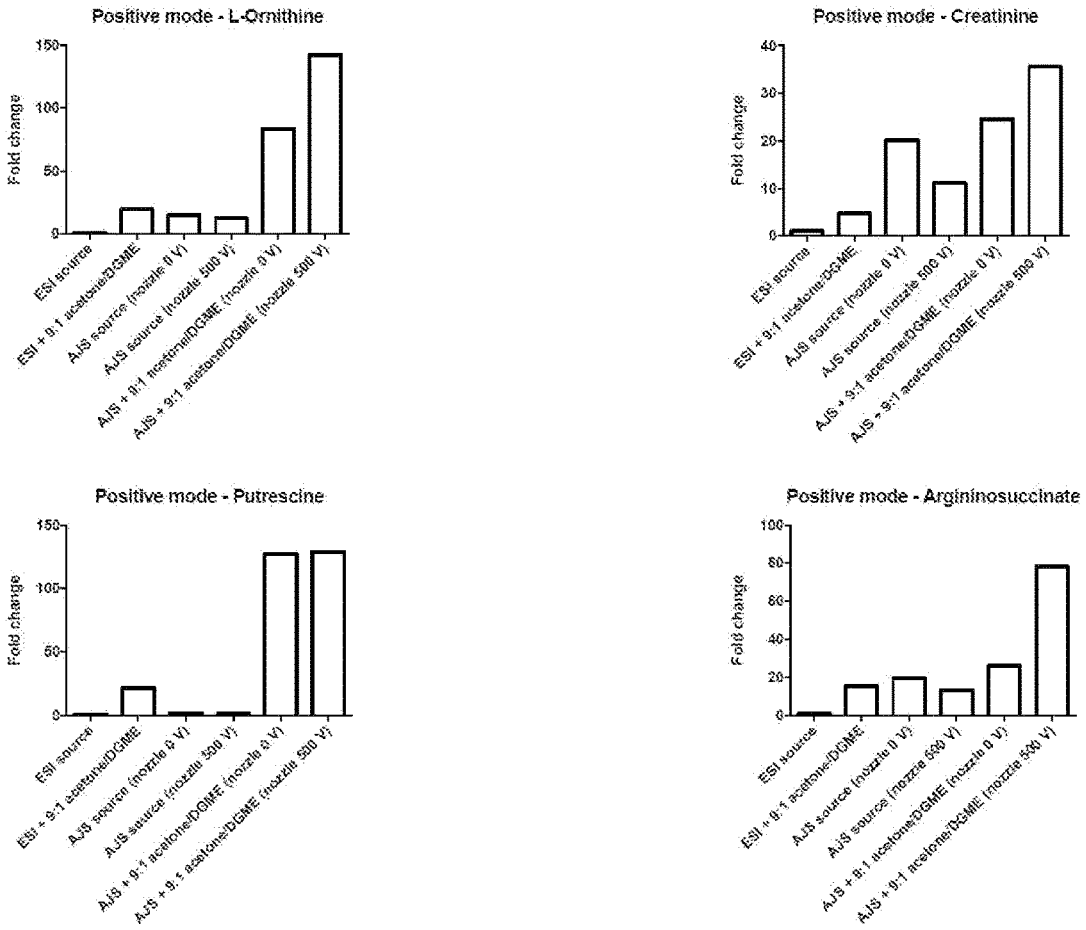
FIG. 4 is a series of graphs showing the sensitivity enhancement is also observed in positive ionization mode, and with alternative instrument sources. In this example the primary liquid stream is a mixture of water and acetonitrile with a flow rate of 400 μL/min. The enhancement solvent is diethylene glycol methyl ether (DGME) and the co-solvent is acetone, in a ratio of 9:1 acetone:DGME. The blend of enhancement solvent and co-solvent is added to the primary liquid stream at 400 μL/min for a total flow of 800 μL/min into the instrument nebulizer. Data is shown for both the Agilent ESI (ESI) and Agilent JetStream (AJS) sources, and for the AJS source nozzle voltages of 0 V and 500 V are evaluated. The data is plotted as fold change relative to the ESI source condition and demonstrates the enhancement effect of the post-column solvent addition is seen for a panel of representative compounds that ionize well in positive mode, using both source designs.
Figure 4:
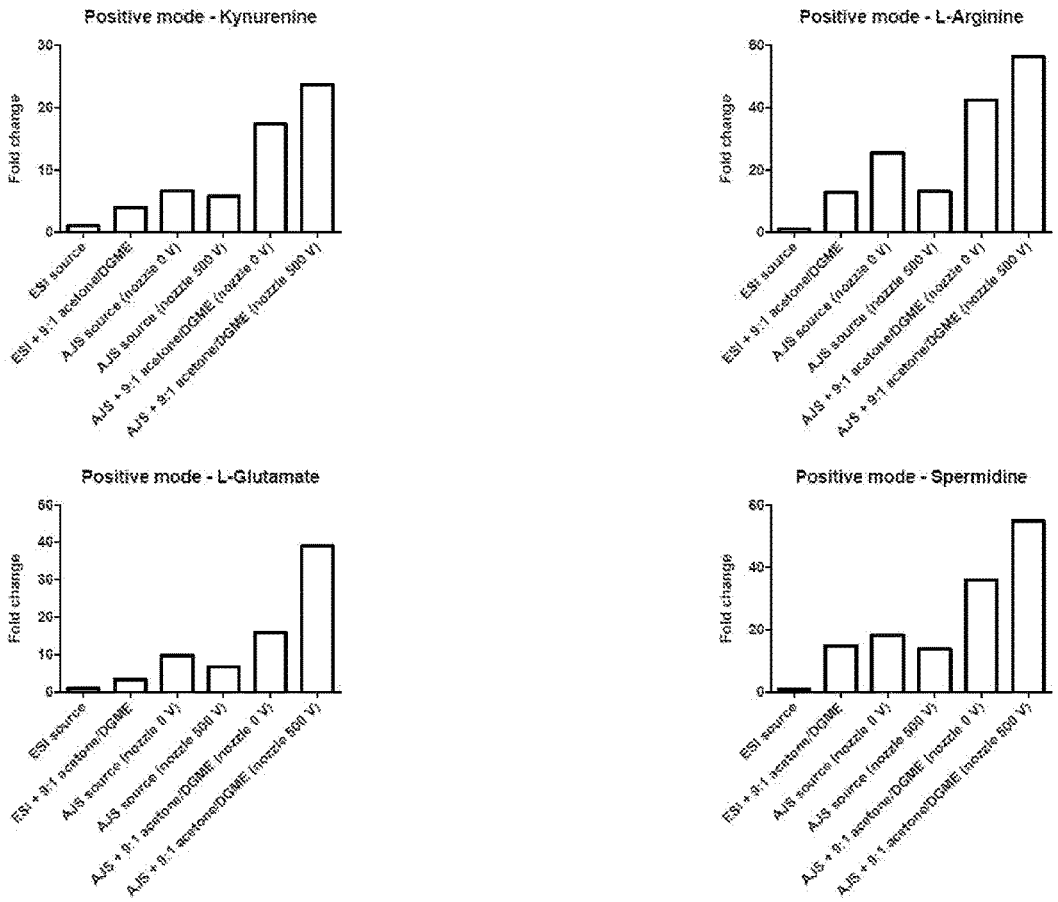

Before describing exemplary embodiments in greater detail, the following definitions are set forth to illustrate and define the meaning and scope of the terms used in the description.

The term "analyte" refers to a collection of covalently or non-covalently bound atoms with a characteristic molecular composition. The term analyte includes biomolecules, which are molecules that are produced by an organism or are important to a living organism, including, but not limited to, proteins, peptides, lipids, DNA molecules, RNA molecules, oligonucleotides, carbohydrates, polysaccharides; glycoproteins, lipoproteins, metabolites, sugars and derivatives, variants and complexes of these.

The term "analyte ion" refers to singly or multiply charged ions, generated by ionizing an analyte in a liquid sample. An analyte ion may have a positive charge, a negative charge or a combination of positive or negative charges. Analyte ions may be formed by evaporation of solvent and/or carrier liquid from charged droplets.

The term "carrier liquid" is used to refer to a liquid in which an analyte is dissolved in the first stream of liquid. If liquid chromatography is used to separate analytes prior to electrospray ionization, then the carrier liquid may contain a mixture of a relatively polar solvent (e.g., water) and a relatively non-polar solvent (e.g., methanol or acentonitrile). In certain instances the carrier liquid may aid in the dispersion of chemical species into droplets. Carrier liquids may contain acetonitrile, dichloromethane (if mixed with methanol), dichloroethane, tetrahydrofuran, ethanol, propanol, methanol, nitromethane, toluene (if mixed with methanol or acetonitrile) and water. Depending on whether electrospray ionization is done in positive or negative mode, the carrier liquid may also contain other compounds (e.g., TFA or ammonium acetate, etc.).

The term "carrier gas" refers to a gas that aids in the formation and/or transport of charged droplets, analyte ions and/or reagent ions in "gas-assisted" nebulization methods. Common carrier gases include, but are not limited to: nitrogen, oxygen, argon, air, helium, water, sulfur hexafluoride, nitrogen trifluoride, carbon dioxide and water vapor.

The term "mass spectrometry" refers to an analytical technique that measures the mass-to-charge (m/z) ratio of ions to identify and quantify molecules in simple and complex mixtures. In some mass spectrometry methods, ions may be separated from one another using time-of-flight (TOF), an orbitrap, a Fourier transform ion cyclotron resonance spectrometer, a quadrupole or an ion trap, for example, and then detected using an ion detector.

The term "fluid communication" refers to the configuration of two or more elements such that a fluid (e.g. a gas, a vapor or a liquid) is capable of flowing from one element to another element. Elements may be in fluid communication via one or more additional elements such as tubes, channels, valves, pumps or any combinations of these.

The term "positive ion mode" refers to operation of a nebulizer comprising a first electrically biased element provided at a positive voltage with respect to a second element (e.g., an opposing plate), where the first electrically biased element and the second element are separated by a distance but are close enough to create a self-sustained electrical gas discharge.

The term "negative ion mode" refers to operation of a corona discharge comprising a first electrically biased element provided at a negative voltage with respect to a second element (e.g., an opposing plate), where the first electrically biased element and the second element are separated by a distance but are close enough to create a self-sustained electrical gas discharge.

Other definitions of terms may appear throughout the specification.

DESCRIPTION OF EXEMPLARY EMBODIMENTS

Before the various embodiments are described in greater detail, it is to be understood that the teachings of this disclosure are not limited to the particular embodiments described, and as such can, of course, vary. It is also to be understood that the terminology used herein is for the purpose of describing particular embodiments only, and is not intended to be limiting, since the scope of the present teachings will be limited only by the appended claims.

The section headings used herein are for organizational purposes only and are not to be construed as limiting the subject matter described in any way. While the present teachings are described in conjunction with various embodiments, it is not intended that the present teachings be limited to such embodiments. On the contrary, the present teachings encompass various alternatives, modifications, and equivalents, as will be appreciated by those of skill in the art.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present teachings, the some exemplary methods and materials are now described.

The citation of any publication is for its disclosure prior to the filing date and should not be construed as an admission that the present claims are not entitled to antedate such publication by virtue of prior invention. Further, the dates of publication provided can be different from the actual publication dates which can need to be independently confirmed.

As will be apparent to those of skill in the art upon reading this disclosure, each of the individual embodiments described and illustrated herein has discrete components and features which can be readily separated from or combined with the features of any of the other several embodiments without departing from the scope or spirit of the present teachings. Any recited method can be carried out in the order of events recited or in any other order which is logically possible.

All patents and publications, including all sequences disclosed within such patents and publications, referred to herein are expressly incorporated by reference.

In conventional electrospray ionization, a first stream of liquid (i.e., a solution) containing a carrier liquid and an analyte, is pumped through a nebulizer that is maintained at a high electrical potential and directed at an opposing plate provided near ground. The electric field at the nebulizer tip charges the surface of the emerging liquid and results in a continuous or pulsed stream of electrically charged droplets. Subsequent evaporation of the solvent from charged droplets promotes formation of analyte ions from species existing as ions in solution. Polar analyte species may also undergo desorption and/or ionization during the electrospray process by associating with cations and anions in solution.

In the present method, a second stream of liquid is added to the first stream of liquid prior to the emergence of the first stream from the nebulizer (e.g., within the nebulizer or upstream of the nebulizer), where the second stream of liquid comprises a co-solvent and an enhancement solvent. The co-solvent has a relatively low boiling point (e.g., a boiling point of between 4° C. and 110° C.), and the enhancement solvent has a relatively high boiling point (e.g., a boiling point of between 150° C. and 300° C.). Depending on how the method is implemented, the addition of the second stream of liquid to the first stream of liquid may result in an increase in sensitivity of detection of an ion of an analyte (i.e., an analyte in the first stream of liquid).

The increase in sensitivity may be at least a 2-fold increase, e.g., at least a 2-, 4-, 5-, 6-, 7-, 8-, 9-, or 10-fold increase in sensitivity.

As noted above, this enhancement can be observed in positive ion mode and negative ion mode. However, if the electrospray ion source is operated positive ion mode, then the enhancement solvent should not be DMSO. As such, in some embodiments the nebulizer may have a large positive electric potential (e.g. about 1,000 V to about 10,000 V) or a large negative electric potential (e.g. about −1,000 V-about −10,000 V) relative to downstream component (e.g., the entrance to the mass spectrometer ion optics). In some embodiments, the nebulizer may be is held at an electric potential about +/−2000 to 5000 V to provide an effective corona discharge.

The co-solvent may be any suitable solvent that has a boiling point of between 4° C. and 110° C. (e.g., a boiling point between 4° C. and 70° C., 4° C. and 60° C., 4° C. and 50° C., or 4° C. and 30° C.). Acetone (boiling point: 56.05° C.), acetonitrile (boiling point: 81.65° C.), methanol (boiling point: 64.6° C.), ethanol (boiling point: 78.5° C.), isopropanol (boiling point: 82.4° C.) and THF (boiling point: 65° C.) are examples of suitable co-solvents, and others (e.g., 2-butanone (boiling point: 79.6° C.), chloroform (boiling point: 61.2° C.), ethyl acetate (boiling point: 77° C.), heptane (boiling point: 98° C.) and methyl t-butyl ether (MTBE) (boiling point: 55.2° C.)) could be employed under some circumstances. In some embodiment, a co-solvent may be chosen because it is miscible in the enhancement solvent and in the first liquid stream. For example, a co-solvent can be chosen because it is miscible in water (if the first liquid stream is aqueous).

The enhancement solvent can be selected as having a boiling point that is at least 40° C., at least 60° C., at least 80° C., at least 100° C., at least 120° C. or at least at least 140° C. greater than the boiling point of the co-solvent. In some embodiments, the boiling point of the enhancement solvent is between 150° C. and 300° C., e.g., between 150° C. and 250° C., between 150° C. and 230° C. or between 150° C. and 200° C.). Dimethyl sulfoxide (DMSO; boiling point: 189° C.), 2-(2-methoxyethoxy)ethanol (boiling point: 194° C. ° C.), and propylene glycol (boiling point: 188.2° C.) are examples of suitable co-solvents, and others (e.g., m-xylene (boiling point: 139.1° C.), p-xylene (boiling point: 138.4° C.), N-methyl-2-pyrrolidinone (NMP) (boiling point: 202° C.), ethylene glycol (boiling point: 195° C.) could be employed under some circumstances. Ideally an ionizer enhancement solvent will not interfere with ionization of analytes.

Suitable solvents and their boiling points may be obtained from the CRC Handbook of Chemistry and Physics, 87th Edition (CRC Press; Jun. 26, 2006), or Vogel's Textbook of Practical Organic Chemistry, 5th Edition (Pearson; Feb. 19, 1996).

In some embodiments, the enhancement solvent and co-solvent are mixed together, stored in a reservoir and transported as a second stream of liquid that is introduced into the first stream of liquid. In general terms, in the second stream of liquid, the enhancement solvent and the co-solvent may be at a relative concentration (v:v) of 1% to 25% (enhancement solvent):75% to 99% (co-solvent), e.g., 3% to 20% (enhancement solvent):80% to 97% (co-solvent), 5% to 15% (enhancement solvent):80% to 95% (co-solvent) or about 10% (enhancement solvent): 90% (co-solvent). The enhancement solvent may represent 1% to 20%, e.g., 2% to 10%, of the resulting liquid stream (i.e., the liquid stream resulting from combining the first and second liquid streams).

In some embodiments, the combined concentration of the enhancement solvent and co-solvent in the resulting liquid (i.e., the liquid stream resulting from combining the first and second liquid streams) is in the range of 1% to 90%, e.g., 5% to 80%, 40% to 60%. In some embodiments approximately 50% of the volume of the resultant liquid is from the second stream of liquid.

The analytes in the first liquid stream may or may not have been separated from each other. In embodiments in which the analytes are separated from each other, the first liquid stream may be output from an instrument that separates liquid phase analytes from one another by, e.g., by affinity, ion exchange, size exclusion, expansion bed adsorption, reverse phase, or hydrophobicity, etc. For example, in some embodiments, analytes in the sample may be separated by an analytical separation device such as a liquid chromatograph (LC), including a high performance liquid chromatograph (HPLC), a micro- or nano-liquid chromatograph or an ultra high pressure liquid chromatograph (UHPLC) device, a capillary electrophoresis (CE), or a capillary electrophoresis chromatograph (CEC) apparatus. However, any manual or automated injection or dispensing pump system may be used. For instance, a subject sample may be applied to the LC-MS system by employing a nano- or micropump in certain embodiments. As would be apparent, the liquid chromatography may be done by high performance liquid chromatography (HPLC), which term is intended to encompass chromatography methods in which a liquid sample containing an analyte is passed through a column filled with a solid adsorbent material under pressure (e.g., of at least 10 bar, e.g., 50-350 bar). In these embodiments, the nebulizer may be in fluid communication with the separation device. Methods for separating analytes in a liquid are well known.

Also as would be apparent, the ionized sample may be analyzed by mass spectrometry. The sensitivity of detection of an analyte using any ESI-MS system is strongly dependent on the ionization efficiency of the analyte. Ionization efficiency depends upon efficient generation of a spray of charged droplets of the mobile phase at the tip of the nebulizer at the electrospray ionization interface, and upon efficient evaporation as the droplets migrate toward the mass spectrometer. The charged droplets contain target ions, i.e., ions of the analyte. As noted above, the addition of the second stream of liquid to the first stream of liquid results in an increase in sensitivity of detection of the ionized analyte. The reasons for the increase in sensitivity are unclear. However, without being bound to any particular theory, it is believed that the addition of the second fluid stream causes differential drying effect. Specifically, the use a co-solvent with a relatively low boiling point results in smaller initial drop formation and rapid drying of the drop until the ionizer enhancement solvent (having a higher boiling point) is essentially the only solvent left for ions to be formed and ejected from.

Mass spectrometer systems for use in the subject methods may be any convenient mass spectrometry system, which in general contains an ion source for ionizing a sample, a mass analyzer for separating ions, and a detector that detects the ions. In certain cases, the mass spectrometer may be a so-called "tandem" mass spectrometer that is capable of isolating precursor ions, fragmenting the precursor ions, and analyzing the fragmented precursor ions. Such systems are well known in the art (see, e.g., U.S. Pat. Nos. 7,534,996, 7,531,793, 7,507,953, 7,145,133, 7,229,834 and 6,924,478) and may be implemented in a variety of configurations. In certain embodiments, tandem mass spectrometry may be done using individual mass analyzers that are separated in space or, in certain cases, using a single mass spectrometer in which the different selection steps are separated in time. Tandem MS "in space" involves the physical separation of the instrument components (QqQ or QTOF) whereas a tandem MS "in time" involves the use of an ion trap. Any of a variety of different mass analyzers may be employed, including time of flight (TOF), Fourier transform ion cyclotron resonance (FTICR), ion trap, quadrupole or double focusing magnetic electric sector mass analyzers, or any hybrid thereof. In one embodiment, the mass analyzer may be a sector, transmission quadrupole, or time-of-flight mass analyzer.

The method described above may be used to analyze a biological sample, where a "biological sample" used herein can refer to a homogenate, lysate or extract prepared from a whole organism or a subset of its tissues, including but not limited to, for example, plasma, serum, spinal fluid, lymph fluid, the external sections of the skin, respiratory, intestinal, and genitourinary tracts, tears, saliva, milk, blood cells, tumors, organs. In embodiments of the invention, a "biological sample" will contain cells from the animal, plants or fungi. A "biological sample" can also refer to a medium, such as a nutrient broth or gel in which an organism has been propagated, which contains cells as well as cellular components, such as proteins or nucleic acid molecules. Biological samples of the invention include cells. The term "cells" is used in its conventional sense to refer to the basic structural unit of living organisms, both eukaryotic and prokaryotic, having at least a nucleus and a cell membrane. In certain embodiments, cells include prokaryotic cells, such as from bacteria. In other embodiments, cells include eukaryotic cells, such as cells obtained from biological samples from animals, plants or fungi.

The present method may be used to analyze analytes, e.g., metabolites, from any of a variety of different cells, including bacterial cells such as *E. coli* cells, and eukaryotic cells such as cells of a lower eukaryote, e.g., yeast, or a higher eukaryote such as a plant (e.g., monocot or dicot) or an animal (e.g., an insect, amphibian, or mammalian etc.). The cells may be cultured cells, or, in certain embodiments, cells from a tissue.

The method described above may be used for metabolomics studies, i.e., systematic studies of the unique chemical fingerprints that are associated with specific cellular processes and the study of their metabolite profiles. The metabolome represents the complete set of small-molecule metabolites (such as metabolic intermediates, hormones and other signaling molecules, and secondary metabolites) to be found within a biological sample, such as a single organism The present method may be employed in a variety of drug discovery, research and diagnostic applications. For example, a subject method may be employed in a variety of applications that include, but are not limited to, diagnosis or monitoring of a disease or condition (where the presence of metabolic profile is indicative of a disease or condition), discovery of drug targets (where, e.g., of metabolic profile associated with a disease or condition and may be targeted for drug therapy), drug screening (where the effects of a drug are monitored by assessing a metabolic profile), determining drug susceptibility (where drug susceptibility is associated with a particular metabolic profile) and basic research (where is it desirable to identify the a metabolic profile in a sample, or, in certain embodiments, the relative levels of a particular metabolites in two or more samples).

In certain embodiments, relative levels of a set of analytes in two or more different samples may be obtained using the above methods, and compared. In these embodiments, the results obtained from the above-described methods are usually normalized to the total amount of a control analytes, and compared. This may be done by comparing ratios, or by any other means. In particular embodiments, the nucleic acid profiles of two or more different samples may be compared to identify analytes that are associated with a particular disease or condition.

In some examples, the different samples may consist of an "experimental" sample, i.e., a sample of interest, and a "control" sample to which the experimental sample may be compared. In many embodiments, the different samples are pairs of cell types, one cell type being a cell type of interest, e.g., an abnormal cell, and the other a control, e.g., normal, cell. If two fractions of cells are compared, the fractions are usually the same fraction from each of the two cells. In certain embodiments, however, two fractions of the same cell may be compared. Exemplary cell type pairs include, for example, cells that are treated (e.g., with environmental or chemical agents such as peptides, hormones, altered temperature, growth condition, physical stress, cellular transformation, etc.), and a normal cell (e.g., a cell that is otherwise identical to the experimental cell except that it is not immortal, infected, or treated, etc.); cells isolated from a tissue biopsy (e.g., from a tissue having a disease such as colon, breast, prostate, lung, skin cancer, or infected with a pathogen etc.) and normal cells from the same tissue, usually from the same patient; cells grown in tissue culture that are immortal (e.g., cells with a proliferative mutation or an immortalizing transgene), infected with a pathogen or a cell isolated from a mammal with a cancer, a disease, a geriatric mammal, or a mammal exposed to a condition, and a cell from a mammal of the same species, preferably from the same family, that is healthy or young; and differentiated cells and non-differentiated cells from the same mammal (e.g., one cell being the progenitor of the other in a mammal, for example).

EXEMPLARY EMBODIMENTS

Various embodiments of the present invention would be apparent to people of ordinary skill in the art based on this disclosure and the state of the art, including but not limited to the following:

1. A method of ionizing a first stream of liquid by an electrospray ion source having a nebulizer, wherein the first stream of liquid may comprise an analyte, the method comprising:
   a) providing the first stream of liquid to the nebulizer;
   b) adding a second stream of liquid to the first stream of liquid in the nebulizer, at an input end of the nebulizer, or upstream of the nebulizer; and wherein the second stream of liquid comprises a co-solvent and an enhancement solvent, the co-solvent having a boiling point between 4° C. and 110° C., and the enhancement solvent having a boiling point between 150° C. and 300° C.; and
   c) nebulizing and ionizing the resulting liquid, wherein, if the enhancement solvent is DMSO, then the nebulizer is run in negative ion mode.
2. The method of embodiment 1, wherein the enhancement solvent comprises DMSO.

3. The method of embodiment 1 or 2, wherein the enhancement solvent comprises 2-(2-methoxyethoxy) ethanol.

4. The method of embodiment 1, 2 or 3, wherein the enhancement solvent comprises propylene glycol.

5. The method of any of the preceding embodiments, wherein the co-solvent is selected from the group consisting of acetone, acetonitrile, methanol, ethanol, isopropanol and THF.

6. The method of any of the preceding embodiments, further comprising separating a sample to produce the first stream of liquid.

7. The method of embodiment 6, wherein the separating is performed by liquid chromatography.

8. The method of embodiment 6, wherein the separating is performed by supercritical fluid chromatography.

9. The method of embodiment 6, wherein the separating is performed by capillary electrophoresis.

10. The method of any of embodiments 1-5, wherein the first stream of liquid comprises a sample in which analytes have not been separated.

11. The method of any of the preceding embodiments, wherein the nebulizing is gas-assisted.

12. The method of any of the preceding embodiments, further comprising ionizing the analyte and subject it to mass spectrometry.

13. The method of any of the preceding embodiments, wherein the boiling point of the co-solvent is between 4° C. and 30° C.

14. The method of any of the preceding embodiments, wherein the boiling point of the co-solvent is between 4° C. and 50° C.

15. The method of any of the preceding embodiments, wherein the boiling point of the co-solvent is between 4° C. and 60° C.

16. The method of any of the preceding embodiments, wherein the boiling point of the co-solvent is between 4° C. and 70° C.

17. The method of any of the preceding embodiments, wherein the boiling point of the enhancement solvent is between 150° C. and 200° C.

18. The method of any of the preceding embodiments, wherein the boiling point of the enhancement solvent is between 150° C. and 230° C.

19. The method of any of the preceding embodiments, wherein the boiling point of the enhancement solvent is between 150° C. and 250° C.

20. The method of any of the preceding embodiments, resulting in an increase in electrospray sensitivity.

21. The method of embodiment 20, wherein the increase is at least 2 fold.

22. The method of embodiment 20, wherein the increase is at least 3 fold.

23. The method of embodiment 20, wherein the increase is at least 4, 5, 6, 7, 8, 9, or 10 fold.

24. The method of prior embodiment, wherein the nebulizer is operated in negative ion mode.

25. The method of any of the preceding embodiments, resulting in an increase of singly-charged ions of the analyte.

26. The method of embodiment 24, wherein the increase is at least 2 fold.

27. The method of embodiment 24, wherein the increase is at least 3 fold.

28. The method of embodiment 24, wherein the increase is at least 4, 5, 6, 7, 8, 9, or 10 fold.

29. The method of any of embodiments 25-28, wherein the electrospray is operated in positive ion mode and the enhancement solvent is not DMSO.

30. The method of any prior embodiment, wherein the enhancement solvent to co-solvent ratio is in the range of 1:1000 to 1:4.

31. The method of any prior embodiment, wherein the enhancement solvent to co-solvent ratio is in the range of 1:200 to 1:5.

32. The method of any prior embodiment, wherein the enhancement solvent to co-solvent ratio is in the range of 1:20 to 1:6.

33. The method of any prior embodiment, wherein the enhancement solvent to co-solvent ratio is in the range of 1:1.

34. The method of any prior embodiment, wherein the combined final concentration of the enhancement solvent and co-solvent in the resulting liquid of (c) is in the range of 1% to 90%.

35. The method of any prior embodiment, wherein the combined final concentration of the enhancement solvent and co-solvent in the resulting liquid of (c) is in the range of 20% to 80%.

36. The method of any prior embodiment, wherein the combined final concentration of the enhancement solvent and co-solvent in the resulting liquid of (c) is in the range of 30% to 70%.

37. The method of any prior embodiment, wherein the combined final concentration of the enhancement solvent and co-solvent in the resulting liquid of (c) is in the range of 40% to 60%.

38. The method of any prior embodiment, wherein the final liquid is nebulized at a rate in the range of 50 μl/min to 400 μl/min.

In order to further illustrate the present method, the specific examples are included with the understanding that they are being offered to illustrate the present invention and should not be construed in any way as limiting its scope.

EXAMPLES

In order to demonstrate the utility of this method the response (signal intensity) for compounds of interest are shown in the representative data. The compounds chosen are typically of interest in a metabolomics analysis of biological samples, such as cell or tissue extracts. The compounds shown in the example data were also chosen for their biological relevance, and because they are well-detected in typical sample matrices and span the mass range of interest. For the negative ionization mode evaluation the compounds shown are: fumarate, L-aspartic acid, 2-hydroxyglutarate, citric acid, ADP, ATP, GDP and GTP. For positive ionization mode evaluation the compounds shown are: L-ornithine, creatinine, putrescine, argininosuccinate, kynurenine, L-arginine, L-glutamate and spermidine.

The liquid chromatography (LC) method, constituting the primary liquid stream, was supplied by an Agilent 1290 Infinity binary UHPLC pump. For negative mode analysis mobile phase A was water containing 5 mM N,N-dimethyloctylamine and 5.5 mM acetic acid. Mobile phase B was 90% methanol, 10% water containing 5 mM N,N-dimethyloctylamine and 5.5 mM acetic acid. The LC separation used a Cortecs C18+ column (150×2.1 mm, 2.7 μm, Waters), held at 30° C. by means of a thermostatted column compartment. For positive mode analysis mobile phase A was water containing 0.1% heptfluorobutyric acid (HFBA) with 0.1% formic acid (FA) and mobile phase B was acetonitrile containing 0.1% HFBA with 0.1% FA. The LC separation used a Zorbax Eclipse plus C18 column (50.0×2.1 mm, 1.8 μm, Agilent) held at 40° C.

The sample used for negative mode analysis was an 80% aqueous methanol extracted prepared from a cultured cell line (CS-1), clarified of protein, dried and re-suspended in mobile phase A. The sample was held at 4° C. prior to injection and the injection volume was 15 μL. Initial LC conditions were 10% B increasing to 100% B at 8.0 minutes. The flow rate was 400 μL/min with 5 minutes of re-equilibration time between injections. The sample used for positive mode analysis consisted of a mixture of chemical standards from Sigma Aldrich prepared at 1 mg/mL in 50:50 acetonitrile:water and then further diluted to a final concentration of ~5 μg/mL in mobile phase A and the injection volume was 5 μL. Initial conditions were 0% B for 1 minute, increasing to 25% B at 8 minutes, and 100% B at 9 minutes. The flow rate was 400 μL/min with 4 minutes re-equilibration time between injections.

Detection was using an Agilent 6230 time-of-flight mass spectrometer. For negative ionization mode evaluations an Agilent dual Electrospray Ionization (ESI) source was used with MS source parameters: 280° C. gas temperature, 13 L/min drying gas, 45 psig nebulizer pressure, 3,500 V capillary voltage, 175 V fragmentor voltage, 65 V skimmer voltage, 750 V octopole 1 RF voltage. For positive mode evaluations both an Agilent dual ESI source and Agilent dual JetStream source (AJS) were used. ESI source conditions was as above, AJS source conditions were: 250° C. gas temperature, 13 L/min drying gas, 45 psig nebulizer pressure, 225° C. sheath gas temperature, 12 L/min sheath gas flow, VCap 3500 V, nozzle voltage 0-1000 V as stated, 175 V fragmentor voltage, 65 V skimmer voltage, 750 V octopole 1 RF voltage. Data was acquired over a mass range from m/z 50-1700, with active mass axis correction.

In order to demonstrate the utility of the present method a secondary liquid stream was added using an Agilent 1260 binary pump, connected to the primary liquid stream by means of a simple tee union, placed in the primary stream after the LC column and before the mass spectrometer nebulizer. Combinations of co-solvent and enhancement solvent could thereby be introduced into the primary liquid stream by varying the blend of solvents supplied by the post-column pump, according to the descriptions accompanying the figures. Collectively the data supplied demonstrate an enhancement in detection for compounds of interest when the co-solvent is acetone and the enhancement solvent is DMSO, propylene glycol or diethylene glycol methyl ether (DGME) in negative mode, and DGME in positive mode. The data supplied also illustrates the combination of both the low boiling point co-solvent (in this case acetone) and high boiling point enhancement solvent (in this case DMSO or DGME) is required to achieve this effect, as neither recapitulates the signal enhancement if added individually. Finally, the data supplied also demonstrate enhancement is seen in both positive and negative ionization modes, and in positive mode when using two different designs of mass spectrometer source. It is therefore likely to be a generally applicable technique.

The invention claimed is:

1. A method of ionizing a first stream of liquid by an electrospray ion source having a nebulizer, wherein the first stream of liquid may comprise an analyte, the method comprising:

a) providing the first stream of liquid to the nebulizer;

b) adding a second stream of liquid to the first stream of liquid in the nebulizer, at an input end of the nebulizer, or upstream of the nebulizer; and wherein the second stream of liquid comprises a mixture of a co-solvent and an enhancement solvent, the co-solvent having a boiling point between 4° C. and 110° C., and the enhancement solvent having a boiling point between 150° C. and 300° C.; and c) nebulizing and ionizing the resulting liquid, wherein, if the enhancement solvent is DMSO, then the electrospray ion source is run in negative ion mode.

2. The method of claim 1, wherein the electrospray ion source is operated in negative ion mode.

3. The method of claim 1, wherein the electrospray ion source is operated in positive ion mode and the enhancement solvent is not DMSO.

4. The method of claim 1, wherein the boiling point of the co-solvent is between 4° C. and 70° C.

5. The method of claim 1, wherein the co-solvent is selected from the group consisting of acetone, acetonitrile, ethanol, isopropanol and THF.

6. The method of claim 1, wherein the co-solvent is acetone.

7. The method of claim 1, wherein the boiling point of the enhancement solvent is between 150° C. and 200° C.

8. The method of claim 1, wherein the enhancement solvent is selected from the group consisting of DMSO, 2-(2-methoxyethoxy)ethanol and propylene glycol.

9. The method of claim 1, wherein the enhancement solvent is DMSO.

10. The method of claim 1, wherein the relative concentration (v/v) of the enhancement solvent to the co-solvent in the second stream of liquid is in the range of 1% to 25% (enhancement solvent):75% to 99% (co-solvent).

11. The method of claim 1, wherein the relative concentration (v/v) of the enhancement solvent to the co-solvent in the second stream of liquid is in the range of 5% to 15% (enhancement solvent):80% to 95% (co-solvent).

12. The method of claim 1, wherein the combined concentration of the enhancement solvent and co-solvent in the resulting liquid of (c) is in the range of 1% to 90%.

13. The method of claim 1, wherein the combined final concentration of the enhancement solvent and co-solvent in the resulting liquid of (c) is in the range of 40% to 60%.

14. The method of claim 1, wherein the resulting liquid is nebulized at a rate in the range of 50 μl/min to 400 μl/min.

15. The method of claim 1, wherein the nebulizing is gas-assisted.

16. The method of claim 1, further comprising separating a sample to produce the first stream of liquid.

17. The method of claim 16, wherein the separating is done by liquid chromatography, supercritical fluid chromatography or capillary electrophoresis.

18. The method of claim 1, wherein the first stream of liquid comprises a sample in which analytes have not been separated.

19. The method of claim 1, further comprising analyzing the ionized sample by mass spectrometry.

20. The method of claim 19, wherein addition of the second stream of liquid to the first stream of liquid results in an increase in sensitivity of detection of the ionized analyte.

* * * * *